United States Patent [19]

Drucker

[11] Patent Number: 5,012,224

[45] Date of Patent: Apr. 30, 1991

[54] AUDIBLE TAG FOR MAGNETIC ELECTRONIC ARTICLE SURVEILLANCE SYSTEMS

[75] Inventor: Frank Drucker, Tamarac, Fla.

[73] Assignee: Sensormatic Electronics Corporation, Deerfield Beach, Fla.

[21] Appl. No.: 563,828

[22] Filed: Aug. 3, 1990

Related U.S. Application Data

[63] Continuation of Ser. No. 446,322, Dec. 5, 1989, abandoned.

[51] Int. Cl.[5] ..... G08B 13/18

[52] U.S. Cl. ..... 340/551; 340/572

[58] Field of Search ..... 340/551, 572

[56] References Cited

U.S. PATENT DOCUMENTS

| | | | |
|---|---|---|---|
| 3,713,133 | 1/1973 | Nathans | 340/572 |
| 3,755,803 | 8/1973 | Cole et al. | 340/572 |
| 4,242,671 | 12/1980 | Plows | 340/572 |
| 4,558,307 | 12/1985 | de Jeude | 340/572 |
| 4,573,042 | 2/1986 | Boyd et al. | 340/572 |
| 4,622,543 | 11/1986 | Anderson, III et al. | 340/551 |
| 4,812,811 | 3/1989 | Äsbrink et al. | 340/572 |

*Primary Examiner*—Glen R. Swann, III

*Attorney, Agent, or Firm*—Robin, Blecker, Daley & Driscoll

[57] ABSTRACT

A tag for use in a magnetic article surveillance system employs an antenna means responsive to a transmitted magnetic signal and a piezoelectric means responsive to the antenna means for generating an audible acoustic signal. Embodiments are provided responding to unmodulated, amplitude modulated, and frequency modulated magnetic signals.

15 Claims, 2 Drawing Sheets

AUDIBLE TAG FOR MAGNETIC ELECTRONIC ARTICLE SURVEILLANCE SYSTEMS

This application is a continuation of application Ser. No. 446,322, filed Dec. 5, 1989, now abandoned.

BACKGROUND OF THE INVENTION

This invention relates to tags for article surveillance systems and, in particular, to tags for magnetic article surveillance systems.

There have been developed over recent years many types of tags for use in magnetic article surveillance systems. In particular, there have been developed a number of so-called "passive" tags which do not require internal power, but which can generate a sensible signal when subjected to a magnetic field. "Passive" tags are considered advantageous because they are less expensive, have longer life and are lighter than tags which utilize internal power sources.

U.S. Pat. No. 4,622,543 discloses one type of magnetic tag in which the tag is formed from a magnetostrictive ferromagnetic strip encased within a hard magnetic container. The magnetic container is adapted, upon being magnetized, to arm the ferromagnetic strip so that it mechanically resonates at a preselected frequency.

When the tag of the '543 patent passes through an interrogation zone in which magnetic energy is transmitted at or near the resonant frequency, the magnetostrictive strip mechanically resonates or vibrates at the resonant frequency. This vibration produces an acoustic signal which is received by an acoustic receiver at a location remote from tag. The receiver processes the acoustic signal and generates an alarm, indicating presence of the tag and its corresponding article in the zone.

While the tag of the '543 patent provides the desired indication that a tag is passing through an interrogation zone, it is sometimes desirable to be able to more closely determine the exact location of the tag in the zone. U.S. Pat. No. 4,573,042 discloses a tag which allows such closer determination by itself emitting an audible sound when in an interrogation zone. The tag of the '042 patent, however, is an active tag adapted for use with radio frequency interrogation signals and is not readily adaptable to magnetic systems.

It is, therefore, a primary object of the present invention to provide an improved tag for a magnetic article surveillance system.

It is a further object of the present invention to provide a passive tag for a magnetic article surveillance system which is able to provide an indication of the location of the tag in the interrogation zone of the system.

It is a further object of the present invention to provide a passive tag for a magnetic article surveillance system in which the tag itself emits an audible signal for location identification.

SUMMARY OF THE INVENTION

In accordance with the principles of the present invention, the above and other objectives are realized in a tag comprising an antenna means and a piezoelectric means responsive to the antenna means for generating an audible acoustic signal. The antenna means and piezoelectric means are adapted to form a circuit responsive to signals at the acoustic resonant frequency of the piezoelectric means, thereby resulting in an audible signal when the antenna means is subjected to a magnetic signal.

BRIEF DESCRIPTION OF THE DRAWINGS

The above and other features and aspects of the present invention will become more apparent upon reading the following detailed description in conjunction with the accompanying drawings, in which.

DETAILED DESCRIPTION

Figure 1:
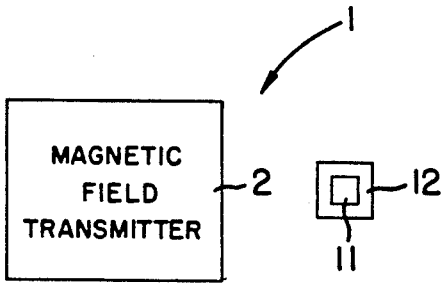
FIG. 1 shows an article surveillance system utilizing a tag in accordance with the principles of the present invention.

FIG. 1 shows a magnetic article surveillance system 1 utilizing a tag 11 in accordance with the principles of the present invention. The system 1 is adapted to detect the presence of articles, such as, for example, the article 12. This is accomplished by affixing the tag 11 to the article 12 and detecting the presence of the tag.

More particularly, the system 1 comprises a transmitter 2 which propagates or transmits a magnetic field in the region of the article 12. The tag 11 is adapted to respond to the magnetic field by generating an acoustic signal.

In accordance with the principles of the invention, the tag 11 is further adapted so that the acoustic signal generated is audible. This permits the location of the tag and article to be more easily and quickly determined.

Figure 2:
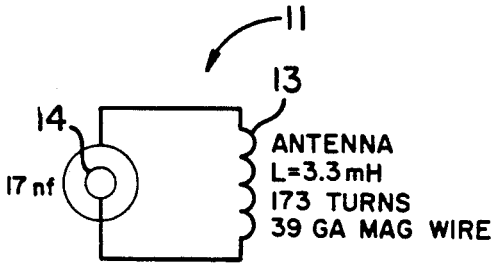
FIGS. 2, 3, and 3*a* illustrate three embodiments of the tag of FIG. 1.

FIG. 2 shows the details of the tag 11. As shown, the tag comprises an antenna 13, which may be fabricated from a number of turns of wire, and a piezoelectric element or crystal 14 whose resonant frequency is in the audible range. The antenna 13 and the crystal 14 are connected in parallel and act to respond to signals at the acoustic resonant frequency of the crystal. This is accomplished by forming the antenna 13 so that its equivalent inductance L and the equivalent capacitance C of the piezoelectric crystal 14 enable the desired response.

When the transmitter 2 transmits a magnetic field of suitable magnitude at or near the resonant frequency of the crystal 14, this field induces a voltage in the circuit formed by the crystal and antenna 13 of the tag 11. The induced voltage then excites the crystal 14 causing it to mechanically vibrate at its resonant frequency. This, in turn, produces the aforementioned audible acoustic signal, which allows the location of the tag 11 to be determined by following the sound.

Figure 3:
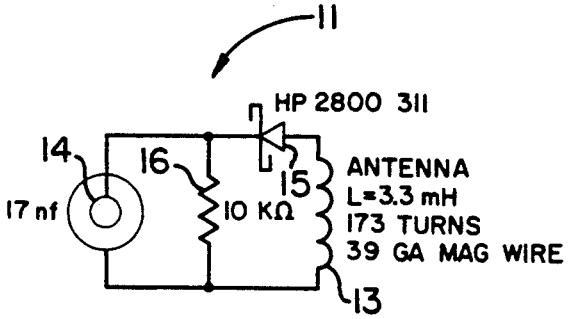

FIG. 3 shows a second embodiment of the tag 11. This embodiment permits the transmitter 2 to operate at frequencies other than the resonant frequency of piezoelectric crystal 14. In particular, in this case, the transmitter 2 transmits a higher frequency signal which is amplitude modulated at the resonant frequency of the crystal.

To be able to respond to the resonant frequency content of the transmitted signal, the tag 11 of FIG. 3 is provided with an AM demodulator which demodulates the signal to recover the resonant frequency signal. In the case shown, the AM demodulator comprises a rectifier, shown as Schotky diode 15, placed in series with the antenna 13 and crystal 14, and a resistor 16 placed in parallel with the crystal. The demodulator makes the circuit of the antenna and crystal responsive to the resonant frequency signal, causing the crystal to mechanically vibrate and deliver the desired audible signal.

In the tags 11 of FIGS. 2 and 3, the electrical circuit formed by the crystal 14 and the antenna 13 need not itself be resonant at the acoustic resonant frequency of the crystal. All that is required is that the circuit be sufficiently responsive at such acoustic resonant frequency to provide a signal to the crystal 14 of high enough level to cause the crystal to mechanically vibrate. Accordingly, in the case of the FIG. 3 embodiment, the resonant frequency of the circuit may be selected to be at the frequency of transmission of the magnetic field so as to promote efficient reception of the signal, as long as the circuit is also sufficiently responsive to the demodulated signal to provide an audible signal from the crystal.

In a particular embodiment of the tag 11 of FIG. 2 of the invention, the piezoelectric crystal 14 was a 7BB-27-4 piezoelectric sounder manufactured by Murata Erie. The crystal had a resonant frequency of approximately 3.3 kHz and an equivalent capacitance of 17 nf. The antenna 13 comprised 173 turns of 39 gauge MAG wire (magnetwire) and had an equivalent inductance of 3.3 mH. The same tag 11 was formed in accordance with the FIG. 3 embodiment by using an HP 2800311 Schotky diode as rectifier element 15 and a 10K resistor as resistor 16

In the system of FIG. 1, the nature of the transmitter 2 will depend upon a variety of factors, an important one of which is the level of the magnetic field needed to cause a discernible audible output from the tag 11. To reduce power requirements, the transmitter 2 may be a unit which is situated in or can be brought into close proximity to the article 12. As an example, the transmitter 2 may be included in a hand held unit which scans the articles.

Figure 4:
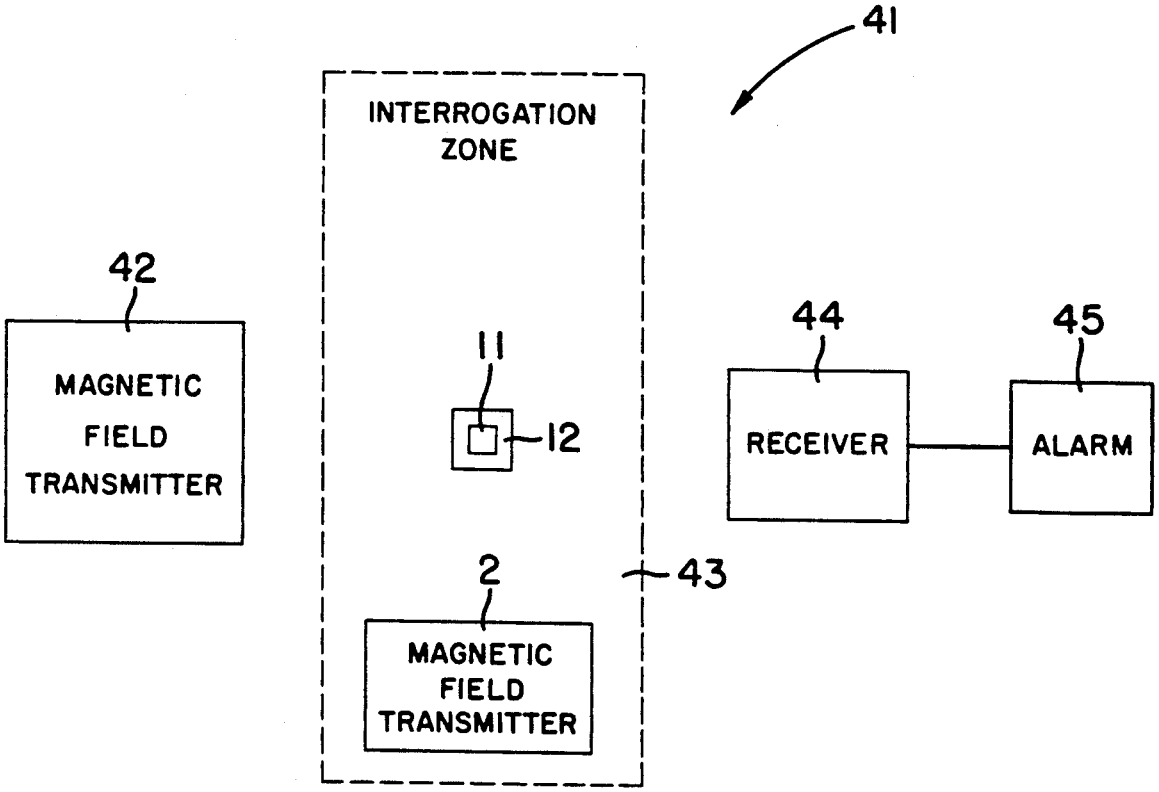
FIG. 4 shows a further article surveillance system using a tag in accordance with the principles of the present invention.

FIG. 4 illustrates an electronic article surveillance system 41 in which the transmitter 2 is such a hand held unit, and in which, prior to use of the transmitter 2, a further transmitter 42 is used to first detect the presence of the tag 11 and article 12 in an interrogation zone 43. More particularly, in the FIG. 4 embodiment, the tag 11 causes perturbations to the magnetic field transmitted from the transmitter 42. These perturbations are electrically detected by an antenna and receiver 44 and the detected perturbations used to sound an alarm 45 to indicate presence of the tag 11 in the zone 43.

Once the alarm 45 has sounded, the transmitter 2 in the hand held unit is brought close to the article 12 in the zone 43 and the transmitter 2 is then caused to transmit its magnetic field. The tag 11 responds to this field by generating an audible acoustic signal, as above-described, thereby identifying the location of the article 12.

In the FIG. 4 embodiment, the field transmitted by the transmitter 42 is preferably at frequency which promotes efficient coupling of energy into the tag 11. More preferably, it is at the resonant frequency of the circuit of the antenna 13 and piezoelectric crystal 14 making up the tag 11. The field transmitted by the transmitter 2, on the other hand, is preferably at a frequency to ensure an audible tag output. More preferably, it is at the acoustic resonant frequency of the crystal 14 of the tag 11.

It should be noted also that by using the tag 11 of FIG. 3, the system of FIG. 4 may be realized without use of a separate hand held unit for the transmitter 2. In particular, the field of the transmitter 42 can serve to cause both an alarm output from the alarm 45 and an audible output from the tag 11 when the tag 11 is present in the zone 43. This can be accomplished by the transmitter 42 transmitting a field which is at the resonant frequency of the circuit of the antenna 13 and crystal 14 and which is also amplitude modulated at the acoustic resonant frequency of the crystal. With this type of field, the circuit of the tag will cause a sufficient perturbation of the transmitted field to alarm the unit 45, while at the same time recovering sufficient modulated signal to cause audible vibration of the crystal 14 in the manner described above.

Another possible modification of the system of FIG. 4, is to also use a single transmitter 42 and to replace the antenna and receiver 44 with an acoustic receiver. In such case, the tag of FIG. 2 would be used. Moreover, the transmitted field would be at the acoustic resonant frequency of the crystal 14 and of such magnitude that the resultant acoustic signal from the crystal would be audible and at a high enough level to be picked up by the receiver 44, causing the alarm 45 to also sound.

Figure 3A:
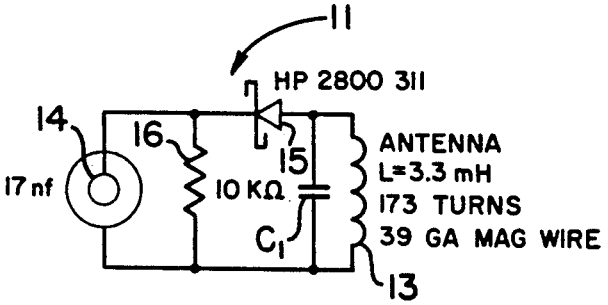

In the case of the FIG. 3 embodiment of tag 11 of the invention, the tag was adapted to respond to a transmitted electromagnetic field that was amplitude modulated at the acoustic resonant frequency of the crystal 14. The tag 11 may instead be designed to be responsive to transmitted electromagnetic waves which are frequency modulated at the latter acoustic resonant frequency. In such case, the tag 11 of FIG. 3 would be further modified to include capacitor $C_1$ (shown in FIG. 3*a*) which together with the antenna inductance L forms a resonant circuit at the acoustic resonant frequency. With such a modification, the tag 11 will act to frequency demodulate the transmitted signal to recover the acoustic resonant frequency signal. The recovered signal will, in turn, then cause the crystal to resonate and provide the audible response.

In all cases it is understood that the above-identified arrangements are merely illustrative of the many possible specific embodiments which respresent applications of the present invention. Numerous and varied other arrangements can readily be devised in accordance with the principles of the present invention without departing from the spirit and scope of the invention.

What is claimed is:

1. A tag for use in a magnetic article surveillance system comprising:

antenna means responsive to a magnetic field;

and piezoelectric means responsive to said antenna means for generating an audible acoustic signal.

2. A tag in accordance with claim 1 wherein:

said piezoelectric means has an acoustic resonant frequency;

said antenna means and said piezoelectric means are connected to form a circuit which is responsive to signals at said acoustic resonant frequency;

and said audible acoustic signal is at said acoustic resonant frequency.

3. A tag in accordance with claim 2 wherein:

said magnetic field is at said acoustic resonant frequency.

4. A tag in accordance with claim 2 wherein:

said magnetic field is at a higher frequency than said acoustic resonant frequency and is modulated at said acoustic resonant frequency;

and said tag further includes demodulator means for demodulating the signal developed by said antenna means in response to said magnetic field and for coupling said demodulated signal to said piezoelectric means.

5. A tag in accordance with claim 4 wherein:
said magnetic field is amplitude modulated at said acoustic resonant frequency;
said piezoelectric means comprises a piezoelectric crystal; and
said demodulator means comprises: a resistor connected across said crystal; and a rectifier having a first end connected to one end of said resistor and a second end connected to one end of said antenna means.

6. A tag in accordance with claim 5 wherein:
said rectifier means comprises a Schotky diode.

7. A tag in accordance with claim 4 wherein:
said magnetic field is frequency modulated at said acoustic resonant frequency
said magnetic field is frequency modulated at said acoustic resonant frequency;
said piezoelectric means comprises a piezoelectric crystal; and
said demodulator means comprises: a resistor connected across said crystal; a capacitor connected across said antenna means; and a rectifier having a first end connected to one end of said resistor and a second end connected to one end of said antenna means.

8. A tag in accordance with claim 1 wherein:
said piezoelectric means comprises a piezoelectric crystal connected across said antenna means.

9. An electronic article surveillance system comprising:
means for transmitting a magnetic field;
and a tag comprising:
antenna means responsive to said magnetic field; and piezoelectric means responsive to said antenna means for generating an audible acoustic signal.

10. A system in accordance with claim 9 wherein:
said piezoelectric means has an acoustic resonant frequency;
said antenna means and said piezoelectric means are connected to form a circuit which is responsive to signals at said acoustic resonant frequency;
and said audible acoustic signal is at said acoustic resonant frequency.

11. A system in accordance with claim 10 wherein:
said magnetic field is transmitted at said acoustic resonant frequency.

12. A system in accordance with claim 10 wherein:
said magnetic field is transmitted at a higher frequency than said acoustic resonant frequency and is modulated at said acoustic resonant frequency;
and said tag further includes demodulator means for demodulating the signal developed by said antenna means in response to said magnetic field and for coupling said demodulated signal to said piezoelectric means.

13. A system in accordance with claim 9 further comprising:
receiver means for receiving said audible signal and generating an alarm.

14. A system in accordance with claim 9 further comprising:
means for transmitting a further magnetic field, said tag being responsive to said further magnetic field and causing a perturbation to said further magnetic field;
and antenna and receiver means for receiving and detecting said perturbation and generating an alarm.

15. A system in accordance with claim 9 wherein:
said tag causes a perturbation to said magnetic field;
and said system further comprises antenna and receiver means for receiving and detecting said perturbation and generating an alarm.

* * * * *